US010781732B2

(12) United States Patent
Nousiainen et al.

(10) Patent No.: US 10,781,732 B2
(45) Date of Patent: Sep. 22, 2020

(54) ACOUSTIC ATTENUATOR FOR DAMPING PRESSURE VIBRATIONS IN AN EXHAUST SYSTEM OF AN ENGINE, AN ACOUSTIC ATTENUATION SYSTEM USING THE ATTENUATORS, AND METHOD OF DAMPING PRESSURE VIBRATIONS IN AN EXHAUST SYSTEM OF AN ENGINE

(71) Applicant: WÄRTSILÄ FINLAND OY, Vaasa (FI)

(72) Inventors: Esa Nousiainen, Vaasa (FI); Jukka Tanttari, Vaasa (FI)

(73) Assignee: WÄRTSILÄ FINLAND OY, Vaasa (FI)

( * ) Notice: Subject to any disclaimer, the term of this patent is extended or adjusted under 35 U.S.C. 154(b) by 339 days.

(21) Appl. No.: 15/575,216

(22) PCT Filed: May 25, 2015

(86) PCT No.: PCT/FI2015/050359
§ 371 (c)(1),
(2) Date: Nov. 17, 2017

(87) PCT Pub. No.: WO2016/189187
PCT Pub. Date: Dec. 1, 2016

(65) Prior Publication Data

US 2018/0149052 A1 May 31, 2018

(51) Int. Cl.
*F01N 1/02* (2006.01)
*F01N 13/02* (2010.01)

(52) U.S. Cl.
CPC ..... *F01N 1/023* (2013.01); *F01N 1/026* (2013.01); *F01N 13/02* (2013.01);
(Continued)

(58) Field of Classification Search
CPC .. F01N 13/02; F01N 2340/02; F01N 2490/15; F01N 2490/155; F01N 2590/10; F01N 1/026; F01N 1/023
(Continued)

(56) References Cited

U.S. PATENT DOCUMENTS 2,297,046 A 9/1942 Bourne
2,580,564 A 1/1952 Ludlow
(Continued)

FOREIGN PATENT DOCUMENTS

WO WO 2005/064127 A1 7/2005
WO WO 2014/076355 A1 5/2014

OTHER PUBLICATIONS

Notification of Transmittal of the International Search Report and Written Opinion of the International Searching Authority, or the Declaration (PCT/ISA/220), International Search Report (PCT/ISA/210), Written Opinion of the International Search Authority (PCT Rule 43bis.1) (PCT/ISA/237) dated Jan. 22, 2016, by the European Patent Office as the International Searching Authority for International Application No. PCT/FI2015/050359. (12 pages).
(Continued)

*Primary Examiner* — Forrest M Phillips
(74) *Attorney, Agent, or Firm* — Buchanan Ingersoll & Rooney PC

(57) ABSTRACT

An acoustic attenuator for damping pressure vibrations in an exhaust system of an engine, the acoustic attenuator having a body which is provided with a gas inlet and a gas outlet at opposite ends thereof, and a gas passage duct arranged between the inlet and the outlet inside the body, where in the body encloses a first resonator chamber and a second resonator chamber. The body is provided with a common inlet communicating with the first and the second resonator chambers, and the resonator chambers are arranged to
(Continued)

extend from the common inlet towards the opposite ends of the body.

14 Claims, 3 Drawing Sheets

(52) U.S. Cl.
CPC ..... *F01N 2340/02* (2013.01); *F01N 2490/15* (2013.01); *F01N 2490/155* (2013.01); *F01N 2590/10* (2013.01)

(58) Field of Classification Search
USPC ..... 181/228, 249
See application file for complete search history.

(56) References Cited

U.S. PATENT DOCUMENTS 3,434,565 A 3/1969 Fischer
5,245,140 A * 9/1993 Wu ..... F01N 13/02 181/232
2005/0252714 A1* 11/2005 Goda ..... B29C 44/583 181/252
2006/0011409 A1* 1/2006 Mabuchi ..... F01N 1/02 181/232
2007/0029133 A1* 2/2007 Hofmann ..... F01N 1/06 181/249
2007/0051556 A1 3/2007 Bogard
2007/0240933 A1 10/2007 Johansson et al.
2010/0270103 A1* 10/2010 Huff ..... F01N 1/02 181/266
2014/0158461 A1* 6/2014 Bertrand ..... F01N 13/08 181/228
2014/0161671 A1* 6/2014 Cuellar ..... F01N 13/08 422/115
2015/0008069 A1* 1/2015 Ogimura ..... F01N 13/08 181/228

OTHER PUBLICATIONS

Written Opinion of the International Preliminary Examining Authority (PCT Rule 66) (PCT/IPEA/408) dated May 11, 2017, by the European Patent Office as the International Searching Authority for International Application No. PCT/FI2015/050359. (4 pages).
Notification of Transmittal of The International Preliminary Report on Patentability (PCT Rule 71.1) (Form PCT/IPEA/416) and International Preliminary Report on Patentability (PCT Article 36 and Rule 70) (Form PCT/IPEA/409) dated Jul. 14, 2017, by the European Patent Office for International Application No. PCT/FI2015/050359. (36 pages).

* cited by examiner

ACOUSTIC ATTENUATOR FOR DAMPING PRESSURE VIBRATIONS IN AN EXHAUST SYSTEM OF AN ENGINE, AN ACOUSTIC ATTENUATION SYSTEM USING THE ATTENUATORS, AND METHOD OF DAMPING PRESSURE VIBRATIONS IN AN EXHAUST SYSTEM OF AN ENGINE

TECHNICAL FIELD

The invention relates to an acoustic attenuator for damping pressure vibrations in an exhaust system of an engine, the acoustic attenuator comprising a body which is provided with a gas inlet and a gas outlet at opposite ends thereof, and a gas passage duct arranged between the inlet and the outlet inside the body, where in the body encloses a first resonator chamber and a second resonator chamber according to the preamble of claim 1.

Invention relates also an acoustic attenuation system using the attenuators, and a method of damping pressure vibrations in an exhaust system of an engine.

BACKGROUND ART

Internal combustion engines produce considerably loud noise in connection with their exhaust gas. Pressure vibrations and noise occur in the exhaust channel and are generated when exhaust gas is discharged from the cylinders of the engine. Noise emitted through exhaust system of the engine is at least a nuisance and in most cases harmful to the environment. Therefore different kinds of attenuation devices arranged to the exhaust systems have been developed.

Noise occurring in the exhaust system can be reduced by using different types of damping techniques. For example, one attenuator type is a reactive attenuator and another is a resistive attenuator.

Reactive attenuators generally consist of a duct section or alike that interconnects with a number of larger chambers. The noise reduction mechanism of reactive attenuators is that the area discontinuity provides an impedance mismatch for the noise wave traveling along the duct. This impedance mismatch results in a reflection of part of the noise wave back toward the source or back and forth among the chambers. The reflective effect of the silencer chambers and ducts (typically referred to as resonators) essentially prevents some noise wave elements from being transmitted past the silencer. The reactive silencers are more effective at lower frequencies than at high frequencies, and are most widely used to attenuate the exhaust noise of internal combustion engines.

WO 2014/076355 A1 discloses an exhaust gas noise attenuator unit comprising at least two reactive attenuation chambers. A first attenuation chamber of the at least two attenuation chambers is arranged in flow connection with the duct section at a first location in longitudinal direction and a second attenuation chamber of the at least two attenuation chambers is arranged in flow connection with the duct section at a second location in longitudinal direction.

It is also known to arrange both reactive and resistive elements into a same attenuator unit. An example of such an element is described in WO 2005/064127 A1 that discloses a sound reduction system for reducing noise from a high power combustion engine. The sound reduction system comprises an element comprising a first reactive part, a resistive part and a second reactive part. The attenuation effect of the element in the low frequencies is mainly achieved by the reactive parts. The attenuating effect in the high frequency area of each element is mainly achieved by the resistive part. The resistive part contributes also to the attenuating effect in the low frequency area as a reflective attenuator.

An object of the invention is to provide an acoustic attenuator which provides efficient attenuation of noise but still allowing a space saving installation in connection with an internal combustion engine exhaust gas system.

DISCLOSURE OF THE INVENTION

Object of the invention is substantially met by an acoustic attenuator for damping pressure vibrations in an exhaust system of an engine, the acoustic attenuator comprising a body which is provided with a gas inlet and a gas outlet at opposite ends thereof, and a gas passage duct arranged between the inlet and the outlet inside the body, where in the body encloses a first resonator chamber and a second resonator chamber.

It is characteristic to the invention that the body is provided with a common inlet communicating with the first and the second resonator chambers and the resonator chambers are arranged to extend from the common inlet towards the opposite ends of the body.

This provides efficient attenuation of noise but still allowing a space saving installation in connection with an internal combustion engine exhaust gas system. The acoustic attenuator according to the invention reduces noise propagation from an internal combustion piston engine into the exhaust system by means of two resonators integrated into the same body. The two resonators are dimensioned so as to produce attenuation at a broader frequency band not obtainable with singular element. The improvement relates to resonator space separation of two resonators and utilization of common, singular connection inlet for both chambers.

According to an embodiment of the invention the gas passage duct is formed of a straight gas duct and the resonator chambers are arranged annularly around the duct, wherein the attenuator comprises two longitudinally spaced intermediate walls radially extending from the gas passage duct to a sleeve part of the body and wherein the common inlet is arranged longitudinally between the intermediate walls.

This way the structure is very versatile for adjusting its properties by only simple changes in the construction, such as changing the diameter and/or length of the sleeve part, and/or changing the position(s) of the intermediate wall(s).

According to an embodiment of the invention the attenuator the resonator chambers are connected with the common inlet via ports arranged to, and supported by the intermediate walls.

According to an embodiment of the invention the gas passage duct is formed of a straight gas duct and the resonator chambers are arranged annularly around the duct, wherein the attenuator comprises two longitudinally spaced intermediate walls radially extending from the gas passage duct to a sleeve part of the body and wherein the common inlet is arranged longitudinally between the intermediate walls and in the attenuator the resonator chambers are connected with the common inlet via ports arranged to, and supported by the intermediate walls).

This provides reduced back-pressure of exhaust system due to straight-thru-flow design as compared to previous singular units, resulting in higher engine or power plant system efficiency and lower emissions.

According to an embodiment of the invention the gas passage duct is directed parallel with a longitudinal axis of the body and the ports are arranged parallel with the longitudinal axis of the body.

Advantageously the port is a tubular member supported by the intermediate wall.

Object of the invention is substantially met by an acoustic attenuation system comprising two acoustic attenuators for damping pressure vibrations in an exhaust system of an engine, in which each of the acoustic attenuator comprising a body which is provided with a gas inlet and a gas outlet at opposite ends thereof, and a gas passage duct arranged between the inlet and the outlet inside the body, where in the body encloses a first resonator chamber and a second resonator chamber, and further the body is provided with a common inlet communicating with the first and the second resonator chambers and the resonator chambers are arranged to extend from the common inlet towards the opposite ends of the body.

It is characteristic to the invention that the gas passage duct has a predetermined length between the common inlet for the first and the second acoustic attenuators in the system.

According to an embodiment of the invention the acoustic attenuators are coupled one after the other in the exhaust system of an internal combustion engine such that the distance between the common inlet for the first and the second acoustic attenuators is determined so as to control acoustic wave phase difference between the acoustic attenuators.

According to an embodiment of the invention the acoustic attenuators are coupled one after the other in the exhaust system of an internal combustion engine such that the distance between the common inlet for the first and the second acoustic attenuators is determined using the formula $$L = \frac{C_0}{4 \cdot F_{GA}}$$

wherein $C_0$=speed of sound in exhaust gas [m/s]

$F_{GA}$=geometric average of adjacently successive tuning frequencies, for example the frequencies F4 and F2 in FIG. 5;

$F_{GA}=\sqrt{(F4*F2)}$

According to an embodiment of the invention the resonator chambers are arranged such that the first resonator chamber of the first attenuator is tuned to attenuate a first frequency and the second resonator chamber of the first attenuator is tuned to attenuate a second frequency, and the first resonator chamber of the second attenuator is tuned to attenuate a third frequency and the second resonator chamber of the second attenuator is tuned to attenuate a fourth frequency, and resonator chambers are tuned to attenuate different frequencies and that two of the tuning frequencies closest to each other are arranged obtainable from separate acoustic attenuators.

According to an embodiment of the invention the resonator chambers are arranged such that the first resonator chamber of the first attenuator is tuned to attenuate a first frequency and the second resonator chamber of the first attenuator is tuned to attenuate a second frequency, and the first resonator chamber of the second attenuator is tuned to attenuate a third frequency and the second resonator chamber of the second attenuator is tuned to attenuate a fourth frequency, and the tuning frequencies are selected so that the third frequency>the second frequency>the fourth frequency>the first frequency.

According to an embodiment of the invention in the acoustic attenuation system the acoustic attenuator is an acoustic attenuator according to anyone of the claims 1-6.

The acoustic attenuators are dimensioned and spatially separated so as to produce attenuation at a broader frequency band than obtainable with singular element. The attenuation is obtained by controlling acoustic wave phase difference between distributed elements by spatial and frequency separation. The obtained attenuation capacity is of higher amplitude and at broader frequency range than that is previously obtained and utilized in such applications.

Object of the invention is substantially met by a method of damping pressure vibrations in an exhaust system of an engine comprising steps of leading exhaust gas from an internal combustion engine via an exhaust gas system to an acoustic attenuator. The invention is characterized by damping the pressure vibrations of the gas by arranging the vibrating gas to communicate with two separate resonator chambers via a common inlet from a gas passage duct of the attenuator to the chambers.

Invention has several general benefits. Firstly the attenuator is such that it is possible to be installed close to the noise source, i.e. the engine thus reducing engine's acoustic or noise radiation and thus effecting on mechanical constructions of exhaust gas system due to generally lower vibration levels. Secondly the attenuator according to the invention requires generally only a small space. The attenuator provides also a reduced back-pressure of exhaust system due to straight-thru-flow design as compared to previous singular units, resulting in higher engine or power plant system efficiency and lower emissions.

In upgrade application the attenuator according to the invention may be easily installed to an existing plant simply by cutting the existing exhaust duct to install the intermediate walls provided with the ports, sleeve part and its endplates.

The attenuator provides also an efficient attenuation of low frequency noise, characteristic to reciprocating internal combustion engine, at broader frequency scale.

The attenuator provides also an efficient means of modularization of the construction and utilization of similar parts with increased manufacturability.

The utilization of the common inlet enables compact size and simple structure also in manufacturing point of view, while still maintaining attenuation of high amplitude and of low frequency acoustic wave.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
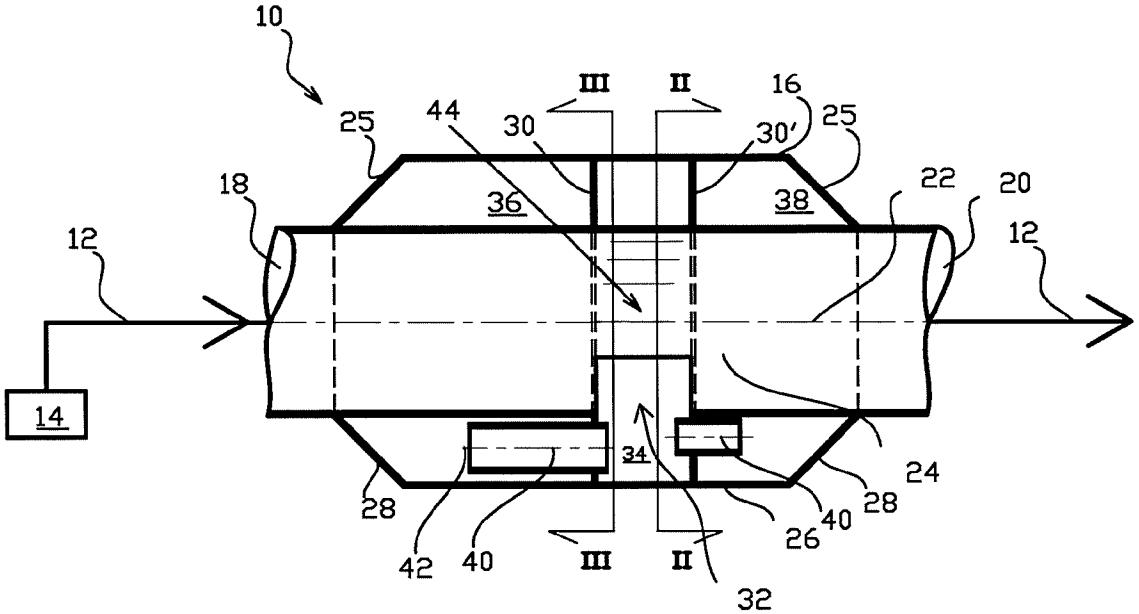
FIG. 1 illustrates an acoustic attenuator in connection with an internal combustion piston engine according to an embodiment of the invention.

FIG. 1 depicts schematically an acoustic attenuator 10 according to an embodiment of the invention. The attenuator is adapted to attenuate exhaust gas noise of an internal combustion piston engine, and in the FIG. 1 the attenuator is arranged to an exhaust gas system 12 of an internal combustion piston engine 14.

The acoustic attenuator comprises a body 16 which is provided with an inlet 18 and an outlet 20 for the exhaust gas to enter and exit the acoustic attenuator. The body 16 is generally an elongated structure which is rotationally symmetrical in respect to its central axis 22. The inlet 18 and the outlet 20 are arranged at opposite ends of the body 16, on the central axis 22. The inlet 18 and the outlet are of equal cross sectional area (diameter when being tubular) and the inlet and the outlet are connected with each other by a gas passage duct 24 extending through the body 16 along the central axis 22. The gas passage is a gas passage duct arranged its centre line to coincide with the central axis 22 of the body 16.

The body 16 is provided with a sleeve part 26 enclosing the gas passage duct 24 over a length in the direction of the central axis 22. There is an annular gap arranged between the sleeve part 26 and the gas passage duct which is closed by end plates 25 at the ends of the sleeve part 26 by end parts 28. The way a closed resonator space is arranged into the annular gap.

The cross sectional area of the sleeve part 26 is greater than the cross sectional area of the gas passage duct. Specifically when the attenuator is of circular cross section, the diameter of the sleeve part 26 is greater than the diameter of the gas passage duct 24 and the sleeve part and the gas passage duct are arranged coaxially.

The body 16 is further provided with two intermediate walls 30, 30'. The intermediate walls 30,30' are arranged to extend radially from the gas passage duct 24 to the sleeve part 26 and circumscribe the gas passage duct 24 forming a gas tight wall to the annular gap between the sleeve part 26 and the gas passage duct. In other words the intermediate wall is an annular plate- or flange-like structure closing the gap between the sleeve part 26 and the gas passage duct. This way there are two closed resonator chambers 36, 38 arranged into the annular gap between respective intermediate wall 30 and the end plate 25. The intermediate walls 30, 30' are arranged at a distance from each other in the longitudinal direction, i.e. in the direction of the central axis 22. There is an opening 32 arranged to the gas passage duct 24, which opening 32 is located in longitudinal direction between the two intermediate walls 30, 30'. The intermediate walls act also as a support structure of the body part 16.

The space bordered by the sleeve part 26, the intermediate walls 30, 30' and the wall of the gas passage duct 24, together with the opening 32 in the gas passage duct 24 forms a common inlet 34 for the gas passage duct such that the gas passage duct is in fluid communication with the first 36 and the second 38 resonator chamber via the common inlet 34 in the body. The resonator chambers 36,38 are arranged to extend in the longitudinal direction from the common inlet towards the opposite ends of the body.

The attenuator is provided with at least one port 40 which are arranged in, and supported by each intermediate wall 30,30' which port opens a communication between the resonator chamber 36,38 and the common inlet 34, i.e. the common inlet 34 is arranged in fluid communication with the resonator chamber 36,38 via the port 40. The ports 40 are tubular members having a central axis 42. The ports 40 and their central axes 42 are arranged parallel with the longitudinal axis of the body 16. The diameter and length of the port tube 40 is dimensioned individually based on the desired attenuation effect of the attenuator. In the attenuator of the invention the precise tuning is straightforward by changing the dimensions of the tubular port. This way the tuning can be adjusted also without changing the dimensions of the body part, which is advantageous in practise.

The distance between the intermediate walls is dimensioned to suit manufacturing process. The minimum distance is defined by wave motion physics to allow efficient connection from main duct into chambers via the tubular ports.

Figure 2:
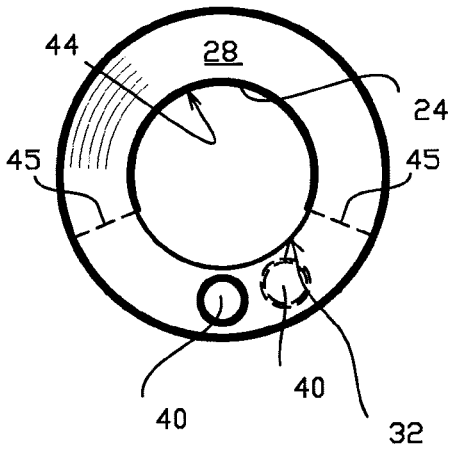
FIG. 2 illustrates a cross sectional view II-II of the attenuator in the FIG. 1.
Figure 3:
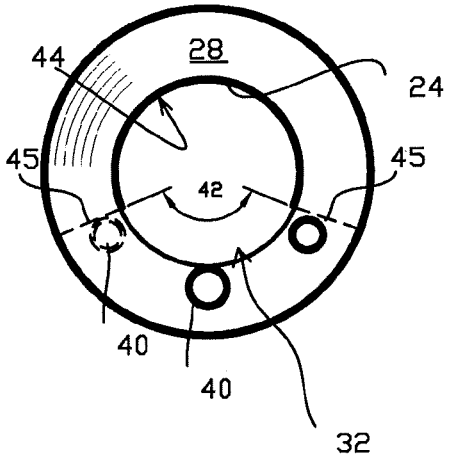
FIG. 3 illustrates a cross sectional view III-III of the attenuator in the FIG. 1.

FIGS. 2 and 3 depicts the cross sectional views II-II and III-III in the FIG. 1. As can be seen there may be provided one or more parallel tubular ports 40 in connection with each of the resonator chamber 36,38. The opening 32 in the gas passage duct 24 is formed by removing a segment 42 from the wall of the gas passage duct. The segment is arranged such that there is a solid wall portion of the gas passage duct 24 extending over the distance between the intermediate walls 30, 30' circumscribing or covering partially the gas passage duct in circumferential direction.

Figure 4:
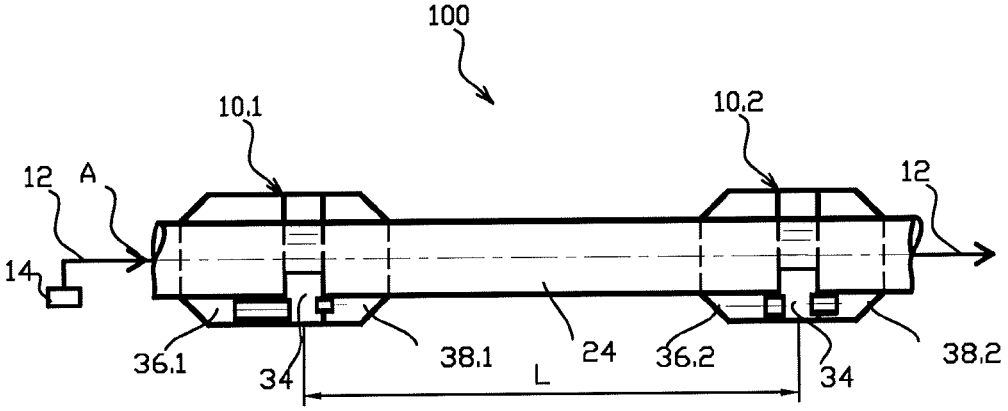
FIG. 4 illustrates an acoustic attenuation system in connection with an internal combustion piston engine according to an embodiment of the invention.

The solid wall portion 44 is an optional feature which has a benefit of closing out a stagnant gas volume between the intermediate walls, to reduce gas accumulation. However, this is not essential for acoustic performance of the attenuator. Additionally the attenuator 10 may be provided with a closing plate 45 extending radially between the solid wall portion and the sleeve part 26 of the body 16, and extending longitudinally between the intermediate walls 30,30'. This is shown with dotted lines in the figures indicating the optional nature of the feature FIG. 4 shows an acoustic attenuation system 100 comprising two acoustic attenuator 10.1,10.2 as is shown in the FIGS. 1 to 3. The acoustic attenuators 10.1,10.2 are coupled one after the other in the exhaust system 12 of an engine such that there is a predetermined distance L of the gas passage duct 24 between the common inlet 34 for the first and the second acoustic attenuators in the system 100. The attenuators 10.1,10.2 are dimensioned and longitudinally separated so as to produce attenuation at a broader frequency band than obtainable with singular element. The attenuation by the acoustic attenuators 10.1,10.2 coupled one after the other in series in the gas passage duct 24 is obtained by controlling acoustic wave phase difference between distributed elements by spatial and frequency separation. The obtained attenuation capacity is of higher amplitude and at broader frequency range than that is previously obtained and utilized in such applications.

The attenuators 10.1, 10.2 are each provided with two resonator chambers 36.1,38.1;36.2,38.2 as is disclosed in the FIG. 1, The chambers are tuned to attenuate noise i.e. vibration in the following manner. The first resonator chamber 36.1 of the first attenuator 10.1 is tuned to attenuate as a center frequency a first frequency F1 and the second resonator chamber 38.1 of the first attenuator 10.1 is tuned to attenuate as a center frequency a second frequency F2, and respectively the first resonator chamber 36.2 of the second attenuator 10.2 is tuned to attenuate as a center frequency a third frequency F3 and the second resonator chamber 38.2 of the second attenuator 10.2 is tuned to attenuate as a center frequency a fourth frequency F4, The tuning frequencies are selected so that the third frequency F3>the second frequency F2>the fourth frequency F4>the first frequency F1. This way the attenuators are utilized in optimized manner. In practise the frequency means a certain range having it attenuation performance above a certain limit.

When considering the system in relation to the gas flow direction, which is shown by an arrow A, the resonator chambers are arranged in the following order: the first resonator chamber 36.1 of the first attenuator 10.1, the second resonator chamber 38.1 of the first attenuator 10.1, the first resonator chamber 36.2 of the second attenuator 10.2 and the second resonator chamber 38.2 of the second attenuator 10.2.

Figure 5:
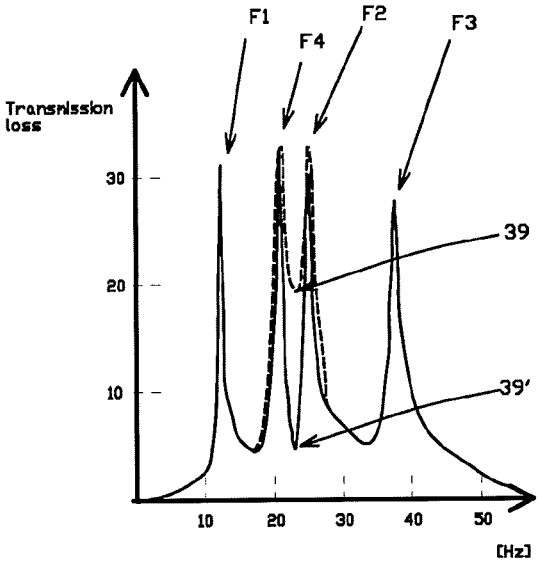
FIG. 5 illustrates an exemplary effect of the acoustic attenuation system of FIG. 4.

In the FIG. 5 there is shown an example of the combined effect of the system 100 in terms of transmission loss. The transmission loss is defined as the difference between the power incident on the acoustic attenuator and that transmitted downstream from the attenuator into an anechoic termination. There are four peaks of transmission loss which represent the center tuning F1 of the first resonator chamber 36.1 of the first acoustic attenuator, the center tuning F4 of the second resonator chamber 38.2 of the second acoustic attenuator, the center tuning F2 of the second resonator chamber 36.2 of the first acoustic attenuator, and the center tuning F3 of the first resonator chamber 38.1 of the second acoustic attenuator. Typical tuning frequencies suitable for a large internal combustion piston engine are for example as follows: F1=12.5 Hz, F2=25 Hz, F3=37.5 Hz, F4=20 Hz. It is advantageous to maximize the ratios F2/F1 and F3/F4.

According to an embodiment of the invention the resonator chambers are tuned to attenuate different frequencies and the frequencies are selected so that two of the tuning frequencies closest to each other are arranged in connection with or obtainable from separate acoustic attenuators 10.1, 10.2.

Now, by means of the combined effect of the predetermined distance L of the gas passage duct 24 between the common inlet 34 for the first and the second acoustic attenuators in the system 100, and the first 10.1 and the second attenuator 10.2 it is possible increase the bottom value 39' of the transmission loss curve at about 23 Hz considerably to the point 39, between the adjacently successive tuning frequencies F4 and F2. Additionally the combined peak of frequencies F4+F4 is widened. In the FIG. 5 the solid line bottom 39' shows the transmission loss obtained by separate attenuator while the dotted line indicates the effect of the tuned system of two attenuators 10.1,10.2 and the gas passage duct 24 having a predetermined length L between the two attenuators 10.1,10.2. This shows clearly how the transmission loss of higher level is expanded over wider range of frequency.

The system 100 forms a band cut filter, in which the attenuation obtained by tuned, distributed attenuators utilizing acoustic phase control between the attenuators. As an example, the system is dimensioned so that the distance between the common inlet for the first and the second acoustic attenuators is determined using the formula $$L = \frac{C_0}{4 \cdot F_{GA}}$$

wherein $C_0$=speed of sound in exhaust gas [m/s]=500 m/s $F_{GA}$=geometric average of adjacently successive tuning frequencies, for example the frequencies F4=20 Hz and F2=25 Hz and thus L=5.6 m.

This way an anti-resonance is provided in the gas passage duct 24, which is adjusted to be between the adjacent successive tuning frequencies. This enhances the operation or technical effects of the adjacent resonators.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

The invention claimed is:

1. An acoustic attenuator for damping pressure vibrations in an exhaust system of an engine, the acoustic attenuator comprising:

a body which is provided with a gas inlet and a gas outlet at opposite ends thereof, a gas passage duct arranged between the inlet and the outlet inside the body, and two longitudinally spaced intermediate walls radially extending from the gas passage duct to a sleeve part of the body, wherein the body encloses a first resonator chamber and a second resonator chamber, and wherein the gas passage duct is provided with:

an opening located in longitudinal direction between the two intermediate walls and a space bordered by the sleeve part and the intermediate walls together with the opening in the gas passage duct forms a common inlet communicating with the first and the second resonator chambers, and the first and second resonator chambers are arranged to extend from the common inlet towards opposite ends of the body.

2. An acoustic attenuator according to claim 1, wherein the gas passage duct between the gas inlet and the gas outlet is provided with a solid, gas impermeable wall, the solid, gas impermeable wall having an opening between the intermediate walls.

3. An acoustic attenuator according to claim 1, wherein the gas passage duct is a straight gas duct and the resonator chambers are arranged annularly around the duct.

4. An acoustic attenuator according to claim 1, wherein the resonator chambers are connected with the common inlet via ports.

5. An acoustic attenuator according to claim 4, wherein the ports and the resonator chambers are arranged such that no gas transmission may take place directly from one resonator chamber to another resonator chamber via a single port.

6. An acoustic attenuator according to claim 4, wherein the ports are arranged to, and supported by the intermediate walls.

7. An acoustic attenuator according to claim 4, wherein the gas passage duct is directed parallel with a longitudinal axis of the body and the ports are arranged parallel with the longitudinal axis of the body.

8. An acoustic attenuator according to claim 6, wherein the port is a tubular member supported by the intermediate wall.

9. An acoustic attenuation system using two acoustic attenuators according to claim 1, wherein in the system the acoustic attenuators are coupled one after the other in an exhaust system of an internal combustion engine and the gas passage duct has a predetermined length (L) between the opening for the first and the second acoustic attenuators in the system.

10. An acoustic attenuation system according to claim 9, wherein the distance between the opening for the first and the second acoustic attenuators is determined such as to control acoustic wave phase difference between the acoustic attenuators.

11. An acoustic attenuation system according to claim 9, wherein the distance between the opening for the first and the second acoustic attenuators is determined using the formula $$L = \frac{C_0}{4 \cdot \sqrt[n]{(F1 \cdot F2 \cdot Fn}}$$

wherein $C_0$=speed of sound in exhaust gas [m/s]

F1, F2, Fn=adjacently successive tuning frequencies.

12. An acoustic attenuation system according to claim 9, wherein the resonator chambers are arranged such that the first resonator chamber (36.1) of the first attenuator is tuned to attenuate a first frequency (F1) and the second resonator chamber of the first attenuator is tuned to attenuate a second frequency (F2), and the first resonator chamber of the second attenuator is tuned to attenuate a third frequency (F3) and the second resonator chamber of the second attenuator is tuned to attenuate a fourth frequency (F4), and wherein the resonator chambers are tuned to attenuate different frequencies and two of the tuning frequencies closest to each other are arranged obtainable from separate acoustic attenuators.

13. An acoustic attenuation system according to claim 12, wherein the third frequency (F3)>the second frequency (F2)>the fourth frequency (F4)>the first frequency (F1).

14. A method of damping pressure vibrations in an exhaust system of an engine comprising:

leading exhaust gas from an internal combustion engine via an exhaust gas system to an acoustic attenuator, wherein the acoustic attenuator has a body which is provided with a gas inlet and a gas outlet at opposite ends thereof, and a gas passage duct arranged between the inlet and the outlet inside the body, wherein the body encloses a first resonator chamber and a second resonator chamber; and damping pressure vibrations of the gas by arranging vibrating gas to communicate with two separate resonator chambers via an opening in the gas passage duct of the attenuator to the chambers, where a space bordered by a sleeve part, intermediate walls, and a wall of the gas passage duct, together with the opening in the gas passage duct forms a common inlet for the gas passage duct, and wherein the first resonator chamber is tuned to attenuate a first frequency (F1) and the second resonator chamber is tuned to attenuate a seconf frequency (F2).

* * * * *